US007272352B2

(12) United States Patent
Kodama

(10) Patent No.: US 7,272,352 B2
(45) Date of Patent: Sep. 18, 2007

(54) IMAGE FORMING APPARATUS WITH HEATING MEMBER CONTROL BASED ON DOOR OPENING STATE AND HEATING MEMBER POSITION

(75) Inventor: Hirokazu Kodama, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/566,302

(22) Filed: Dec. 4, 2006

(65) Prior Publication Data

US 2007/0092312 A1 Apr. 26, 2007

Related U.S. Application Data

(62) Division of application No. 10/943,837, filed on Sep. 20, 2004, now Pat. No. 7,209,695.

(30) Foreign Application Priority Data

Sep. 24, 2003 (JP) ..... 2003-331931

(51) Int. Cl.
*G03G 15/20* (2006.01)

(52) U.S. Cl. ..... 399/328; 219/216

(58) Field of Classification Search ..... 399/33, 399/36, 37, 67, 69, 320, 328; 219/216
See application file for complete search history.

(56) References Cited

U.S. PATENT DOCUMENTS

| | | | | |
|---|---|---|---|---|
| 4,791,453 | A | 12/1988 | Koseki et al. | 399/82 |
| 5,802,421 | A | 9/1998 | Miura | 399/33 |
| 6,059,285 | A | 5/2000 | Suga et al. | 271/228 |
| 6,408,159 | B2 | 6/2002 | Ishizuka et al. | 399/325 |
| 6,931,220 | B2 | 8/2005 | Nakaya | 399/70 |
| 6,968,137 | B2 | 11/2005 | Tatematsu et al. | 399/69 |

FOREIGN PATENT DOCUMENTS

| | | |
|---|---|---|
| CN | 1298127 | 11/2000 |
| JP | 61-188572 | 8/1986 |
| JP | 5-127567 | 5/1993 |
| JP | 10-149044 | 6/1998 |
| JP | 11-24461 | 1/1999 |
| JP | 11-24489 | 1/1999 |
| JP | 2000-214718 | 8/2000 |
| JP | 2000-338815 | 12/2000 |
| JP | 2001-154529 | 6/2001 |
| JP | 2001-265154 | 9/2001 |
| JP | 2002-50462 | 2/2002 |
| JP | 2002-247752 | 8/2002 |
| JP | 2003-255751 | 9/2003 |

*Primary Examiner*—Robert Beatty
(74) *Attorney, Agent, or Firm*—Fitzpatrick, Cella, Harper & Scinto

(57) ABSTRACT

An image forming apparatus has a fixing unit for heat fixing an unfixed image formed on a recording material at a nip, with the fixing unit having a rotary fixing member disposed for contacting with the recording material; a heating member for externally heating the rotary fixing member; and a control for stopping revolution of the rotary fixing member in association with a door opening in the image forming apparatus, wherein the heating unit is controlled in association with the door opening state and the contact state of the heating member and fixing member.

7 Claims, 14 Drawing Sheets

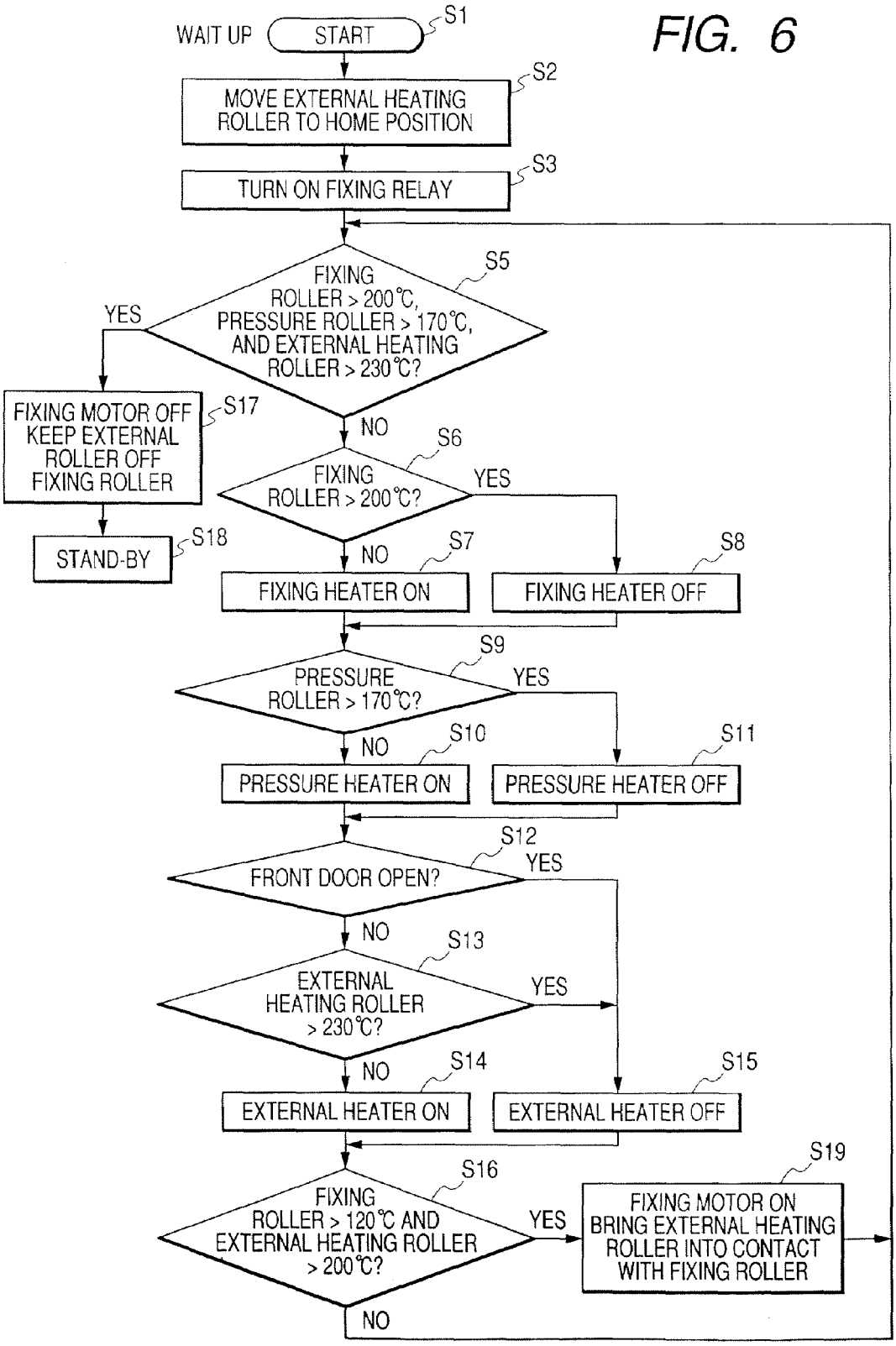
FIG. 6
WAIT UP
START
S1
MOVE EXTERNAL HEATING ROLLER TO HOME POSITION
S2
TURN ON FIXING RELAY
S3
FIXING ROLLER > 200℃, PRESSURE ROLLER > 170℃, AND EXTERNAL HEATING ROLLER > 230℃?
S5
YES
NO
FIXING MOTOR OFF KEEP EXTERNAL ROLLER OFF FIXING ROLLER
S17
STAND-BY
S18
FIXING ROLLER > 200℃?
S6
YES
NO
FIXING HEATER ON
S7
FIXING HEATER OFF
S8
PRESSURE ROLLER > 170℃?
S9
YES
NO
PRESSURE HEATER ON
S10
PRESSURE HEATER OFF
S11
FRONT DOOR OPEN?
S12
YES
NO
EXTERNAL HEATING ROLLER > 230℃?
S13
YES
NO
EXTERNAL HEATER ON
S14
EXTERNAL HEATER OFF
S15
FIXING ROLLER > 120℃ AND EXTERNAL HEATING ROLLER > 200℃?
S16
YES
NO
FIXING MOTOR ON BRING EXTERNAL HEATING ROLLER INTO CONTACT WITH FIXING ROLLER
S19

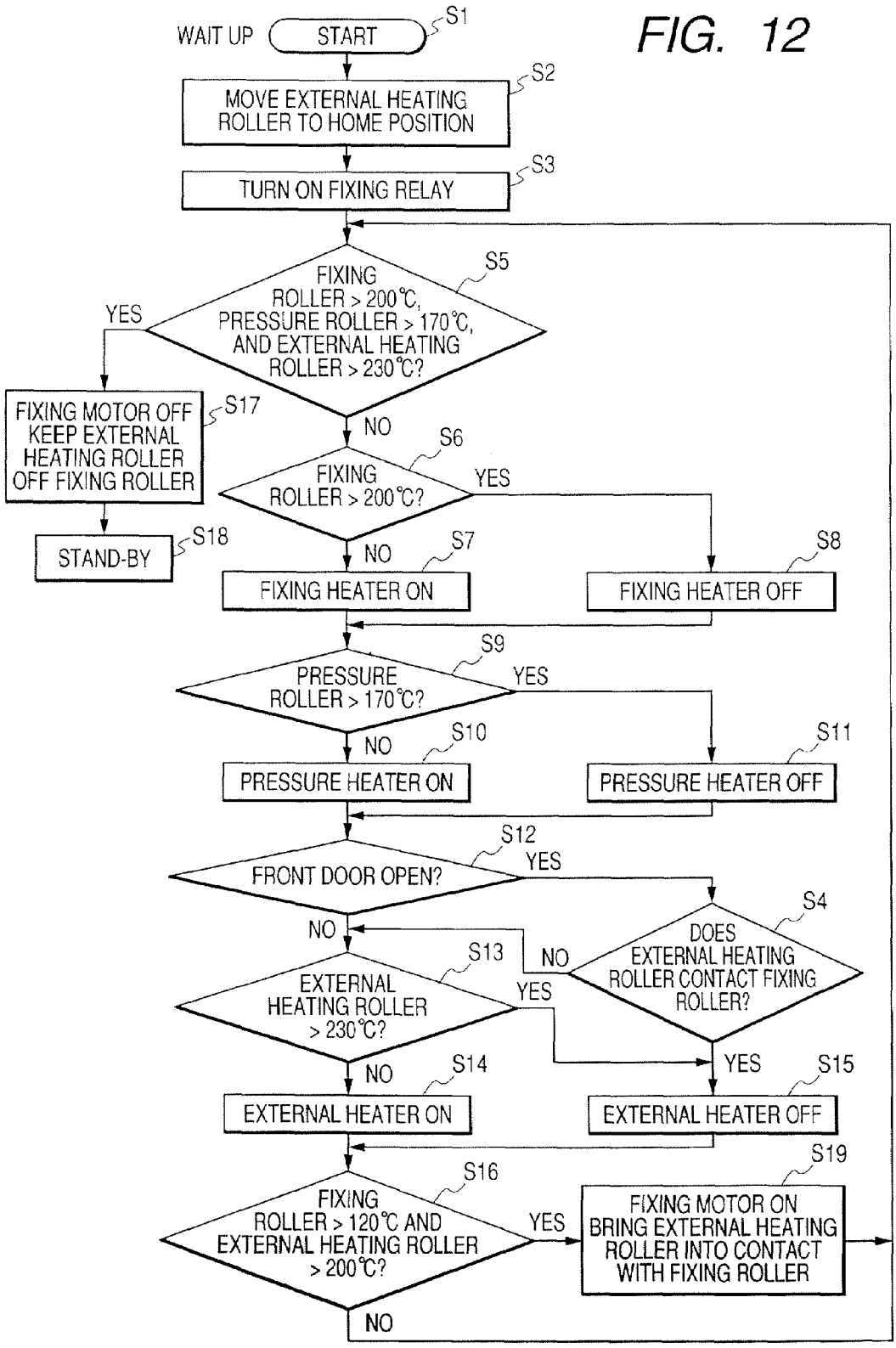
FIG. 12
WAIT UP
START
S1
MOVE EXTERNAL HEATING ROLLER TO HOME POSITION
S2
TURN ON FIXING RELAY
S3
FIXING ROLLER > 200℃, PRESSURE ROLLER > 170℃, AND EXTERNAL HEATING ROLLER > 230℃?
S5
YES
FIXING MOTOR OFF KEEP EXTERNAL HEATING ROLLER OFF FIXING ROLLER
S17
STAND-BY
S18
NO
FIXING ROLLER > 200℃?
S6
YES
NO
S7
FIXING HEATER ON
S8
FIXING HEATER OFF
PRESSURE ROLLER > 170℃?
S9
YES
NO
S10
PRESSURE HEATER ON
S11
PRESSURE HEATER OFF
FRONT DOOR OPEN?
S12
YES
NO
EXTERNAL HEATING ROLLER > 230℃?
S13
NO
YES
DOES EXTERNAL HEATING ROLLER CONTACT FIXING ROLLER?
S4
YES
NO
S14
EXTERNAL HEATER ON
S15
EXTERNAL HEATER OFF
FIXING ROLLER > 120℃ AND EXTERNAL HEATING ROLLER > 200℃?
S16
YES
FIXING MOTOR ON BRING EXTERNAL HEATING ROLLER INTO CONTACT WITH FIXING ROLLER
S19
NO

IMAGE FORMING APPARATUS WITH HEATING MEMBER CONTROL BASED ON DOOR OPENING STATE AND HEATING MEMBER POSITION

This application is a divisional of U.S. patent application Ser. No. 10/943,837, filed Sep. 20, 2004, now U.S. Pat. No. 7,209,695.

BACKGROUND OF THE INVENTION

1. Field of the Invention

The present invention relates to an image forming apparatus using an electro-photography or electrostatic imaging method, especially to an image forming apparatus for a copier, printer or facsimile.

2. Related Background Art

Conventionally, in an image forming apparatus for a copier, laser printer or facsimile, such a fixing apparatus is known to be constructed of a fixing roller equipped therein with a heating source such as halogen lamp and a pressure roller equipped likewise with a heat source and pressure-mounted onto the fixing roller, feed through a recording sheet holding an unfixed toner image thereon between the fixing and the pressure rollers, let the softened toner by the above described fixing roller seep into the gaps among fibers of the recording sheet and fix the unfixed toner image onto the recording sheet.

The halogen lamps as heat source for the fixing and the pressure rollers are on- and off-controlled respectively by the individual signals from a temperature sensor each mounted on the surface of the fixing and the pressure rollers, and thereby the each surface is controlled at a preset temperature.

In such constructed fixing apparatus utilizing a heat roller method, a pressure point is formed between the two rollers (hereinafter referred to as "nip") due to an elastic deformation of the elastic layer of the fixing roller. And in such a fixing apparatus, the unfixed toner image is melted and fixed onto the recording sheet by the thermal energy and the pressure by feeding a recording sheet carrying an unfixed image thereon through the nip.

In such constructed fixing apparatus as described above, the fixing and the pressure rollers has an elastic layer which consists of elastic body such as silicone rubber having a certain thickness and therefore its coefficient of thermal conductivity being relatively low. Consequently, in the above described fixing apparatus, if the surface temperature on the fixing or the pressure rollers decreases when the recording sheet is fed, a time lag may occur between the time when the halogen lamp is turned on by the temperature detection signal from the sensor and the time when the halogen lamp heat is conducted through the elastic layer to the surface, possibly causing a fixing failure. Especially with a higher process speed, such a fixing failure is prone to occur and a problem may result such as a limited continuous printing speed in order to avoid such a fixing failure.

As a solution for such problem, a technique has already been proposed to alleviate a temperature drop on a fixing roller surface by pressure-mounting an external heat roller with its temperature being maintained high, as disclosed in Japanese Patent Application Laid-Open Nos. H10-149044 and H11-24489.

However, such fixing apparatus has had a problem of damage or degradation in the fixing roller if the external heating roller keeps contact with a stationary fixing roller, due to a continuous, local heating of the fixing roller by the external heating roller even if the surface temperatures of the both rollers are controlled within each applicable temperature. Such degradations in the fixing roller surface cause problems including image defects such as image streaks and gloss defects, toner adhesion (offset) due to a decreased toner releasing capability and recording paper stripping failures.

As a solution for such problems, a technique has already been proposed in which an external heating roller is set up detachably with a fixing roller and the fixing roller is rotated load-free by rotation drive means until the external heating roller comes in contact therewith, as disclosed in Japanese Patent Application Laid-Open No. H11-24461.

Also in the conventional image forming apparatus described above, an interlock function is equipped as protection means for stopping the drive system by shutting the electric power off the load system in such cases where the machine operator opens (hereafter referred to as "door opening") an external cover (hereafter referred to as "front door") for a jam removal and the like.

Such image forming apparatus, however, has problems as follows when the interlock function is in operation by a door opening.

If the interlock function is in operation by a door opening with the external heating roller in contact with the fixing roller, both of the rollers are forced to stop rotating instantly, and the drive means detaching the external heating roller from the fixing roller is also forced to be inoperable, causing a part of the fixing roller contacting with the external heating roller to be locally heated thereby, if the heater mounted in the external heating roller is kept powered on, resulting in the local degradation of the fixing roller surface.

Particularly because the temperature of the external heating roller is maintained higher than that of the fixing roller, such local damage is unavoidable, hence requiring a definite solution.

SUMMARY OF THE INVENTION

A purpose of the present invention is to provide an image forming apparatus capable of preventing degradation of a rotary fixing member.

Another purpose of the present invention is to provide an image forming apparatus capable of executing an image forming operation quickly after a front door is closed in the image forming apparatus.

A further purpose of the present invention is to provide an image forming apparatus, comprising: fixing means for heat fixing an unfixed image formed on a recording material at a nip, the fixing means having a rotary fixing member contactable with the recording material; heating means for effecting heating of the rotary fixing member from an external of the rotary fixing member; and means for stopping rotation of the rotary fixing member in association with a door opening in the image forming apparatus, wherein the heating means stops the heating in association with a door opening in the image forming apparatus, wherein the heating means stops the heating operation in association with the door opening.

A further purpose of the present invention is to provide an image forming apparatus, comprising: fixing means for heat fixing an unfixed image formed on a recording material at a nip, with the fixing means having a rotary fixing member disposed for freely contacting with the recording material; a heating member heating the rotary fixing member while being in contact with the rotary fixing member on an outer surface thereof; means for making contact between the rotary fixing member and the heating member, or detaching the one from the other; and means for linking a door opening in the image forming apparatus with detaching the heating member from the rotary fixing member.

A still further purpose of the present invention is made clear by reading the detailed description as follows referring to the attached drawings herein.

BRIEF DESCRIPTION OF THE DRAWINGS

FIG. 6 illustrates a control flow chart for an image forming apparatus according to the present invention;

FIG. 12 illustrates a control flow chart for an image forming apparatus relating to the present invention;

DESCRIPTION OF THE PREFERRED EMBODIMENTS

Figure 1:
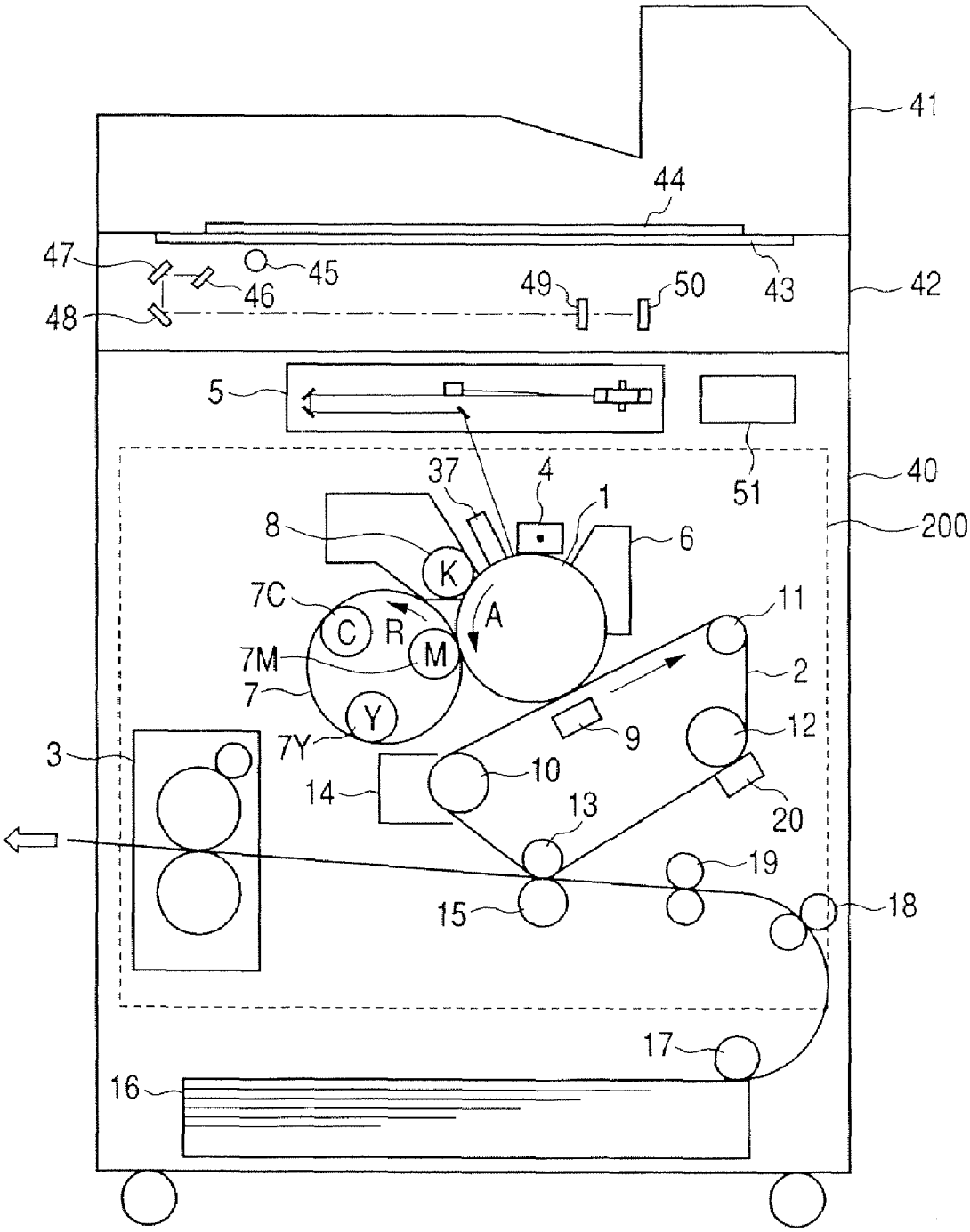
FIG. 1 illustrates a construction of an image forming apparatus relating to the present invention.

Embodiments relating to the present invention are described below.

Embodiment 1

Referring to the drawings, a configuration of the embodiment 1 is described as follows.

FIG. 1 illustrates a construction of a color copier as an image forming apparatus applied by a fixing apparatus relating to the embodiment of the present invention. It shall be noted that a fixing apparatus relating to the embodiment of the present invention is also applicable to image forming apparatuses for a printer or facsimile or the like.

(An Overall Construction of Image Forming Apparatus)

Referring to FIG. 1, the numeral 40 illustrates the main body of a color electro-photography copier, in the upper part of which is mounted with an automatic original conveying apparatus 41 for separating and conveying originals 44 one sheet at a time, and with an original readout apparatus 42 for reading out the image on the original 44 fed thereto by the automatic original conveying apparatus 41. The original readout apparatus 42 is such that the original 44 placed on a platen glass 43 is illuminated by an exposure lamp 45; the reflected light image from the original 44 is scanned and exposed into an image readout device 50 consisting of CCD, et cetra, through an optical reduction system consisting of optical mirrors 46, 47 and 48, and an imaging lens 49; and the image readout device 50 reads out color material reflection optical images on the original 44 in a predetermined dot density.

The color material reflection optical images read out from the original 44 by the original readout apparatus 42 in the form of three-color data, consisting of red (R), green (G) and blue (B), are sent to an image processing apparatus 51 in which image processing are done for each of R, G and B data such as shading correction, gamma correction and color space processing.

The image data having gone through the predefined image processing in the image processing apparatus 51 are then sent as image data for yellow (Y), magenta (M), cyan (C) and black (K) to an image control part 52 in which image scanning by laser beam is performed corresponding to the image data.

Image exposure by an exposure apparatus 5 is performed onto a photosensitive drum 1 (hereinafter called "photosensitive member"). The drum 1 is mounted in such a way to be rotated in the direction of arrow A by a not-shown motor. Over the circumference of the photosensitive member 1, are mounted the primary charging device 4, a voltage sensor 37, the image control apparatus 5, a color development unit 7, a black and white development unit 8, a transfer charging device 9 and a cleaning apparatus 6.

For image forming, the charging apparatus 4 is first applied with voltage for charging the surface of the photosensitive member 1 uniformly in a negative charge at a predefined voltage at the charging position. The charging level is detected by the voltage sensor 37, the resultant of which is fed back for controlling the output of the charging apparatus 4. The exposure apparatus 5 consisting of a laser scanner then exposure-scans, based on the image data, on the charged photosensitive member 1 so that the image part of the photosensitive member 1 is charged with the predefined voltage at the exposure position, hence forming a latent image. The image control part 5 performs on-off controls based on the image data and thereby forming a latent image corresponding to the image.

The color development unit 7 consists of three development apparatus 7Y, 7M and 7C for a full color development. The color development apparatus 7Y, 7M and 7C, and the black development apparatus 8 develop the respective latent image on the photosensitive member 1 with Y, M, C and K toners, respectively. For each color development, a not-shown motor rotates the color development unit 7 in the direction of arrow R so that each applicable color development apparatus comes into a close proximity to the photosensitive member 1.

Each color toner image developed on the photosensitive member 1 is transferred, by means of transfer charging device 9, onto an intermediate transfer belt 2 in sequence and on top of the other color, hence the four color images stacking together. On the opposite side of the intermediate transfer belt 2 from a transfer belt drive roller 10, is mounted a belt cleaner 14 for its blade scraping off the remaining toner on the belt 2.

The toner image transferred onto the belt 2 is then transferred onto a recording sheet (recording material)

through the secondary transfer apparatus 15. For a full color print, after the four color toners are stacked together on the belt, they are transferred onto the recording sheet. The above described recording sheet is first fed out from a recording sheet cassette 16 to the conveying path by a pickup roller 17, and then to the nip part, that is where the secondary transfer apparatus 15 comes into contact with the belt 2, by conveying roller pairs 18 and 19.

And the toner left on the photosensitive member is provided with a charge level suitable for cleaning by an auxiliary cleaning apparatus, and then removed and collected by the cleaning apparatus 6 so that eventually the photosensitive member 1 is discharged uniformly to nearly zero volt by a not-shown discharging apparatus, making ready for the next image forming cycle.

The recording sheet transferred with a toner image thereon is then conveyed to a fixing apparatus 3. The toner image on the recording sheet is heat fixed by the fixing apparatus 3 and then fed to outside the image forming apparatus.

And now, the image forming timing in the above described color copier is controlled by a predefined position on the belt 2 as basis. The belt 2 is mounted to rollers 10, 11, 12, and 13 with a tension. Among these rollers, the transfer belt drive roller 10 is coupled with a not-shown drive source and is functioned as drive roller for driving the belt 2, the transfer belt tension rollers 11 and 12 are functioned as tension rollers for adjusting the tension of the belt 2, and the backup roller 13 is functioned as backup rollers for a transfer roller 15, as the secondary transfer apparatus.

In the adjacent area to the tension roller 12, a reflective sensor 20 is disposed for detecting the basic position. The reflective sensor 20 detects a marking such as a reflective tape attached onto the edge of the outer surface of the belt 2 and outputs the I-top signal.

The ratio of the circumferential lengths between the above described photosensitive member 1 and the belt 2 is defined as an integer ratio 1:n (where n denotes an integer). With this ratio, while the belt 2 goes around one circumferential length, the photosensitive member 1 rotates an integer number of revolutions and therefore its position goes back to exactly the same position as before the belt going around that much, thus preventing an error in the rotation of the photosensitive member 1 otherwise causing a color misregistration while the four colors are being stacked on top of each other on the intermediate transfer belt 2 (which goes around four times the circumference).

In an image forming apparatus using the intermediate transfer belt as described above, at a predetermined timing after detecting the I-top signal, the image control part 5 consisting of laser scanner starts exposure-scanning. Also as described above, while the belt 2 goes around one circumference the photosensitive member 1 rotates an integer number of revolutions and therefore its position goes back to exactly the same position as before the belt going around that much, thus enabling the toner image always at the same position on the intermediate transfer belt 2. Although the area size of toner images varies with paper size, there are areas where no toner images are transferred thereon.

(Control System of an Image Forming Apparatus)

Figure 2:
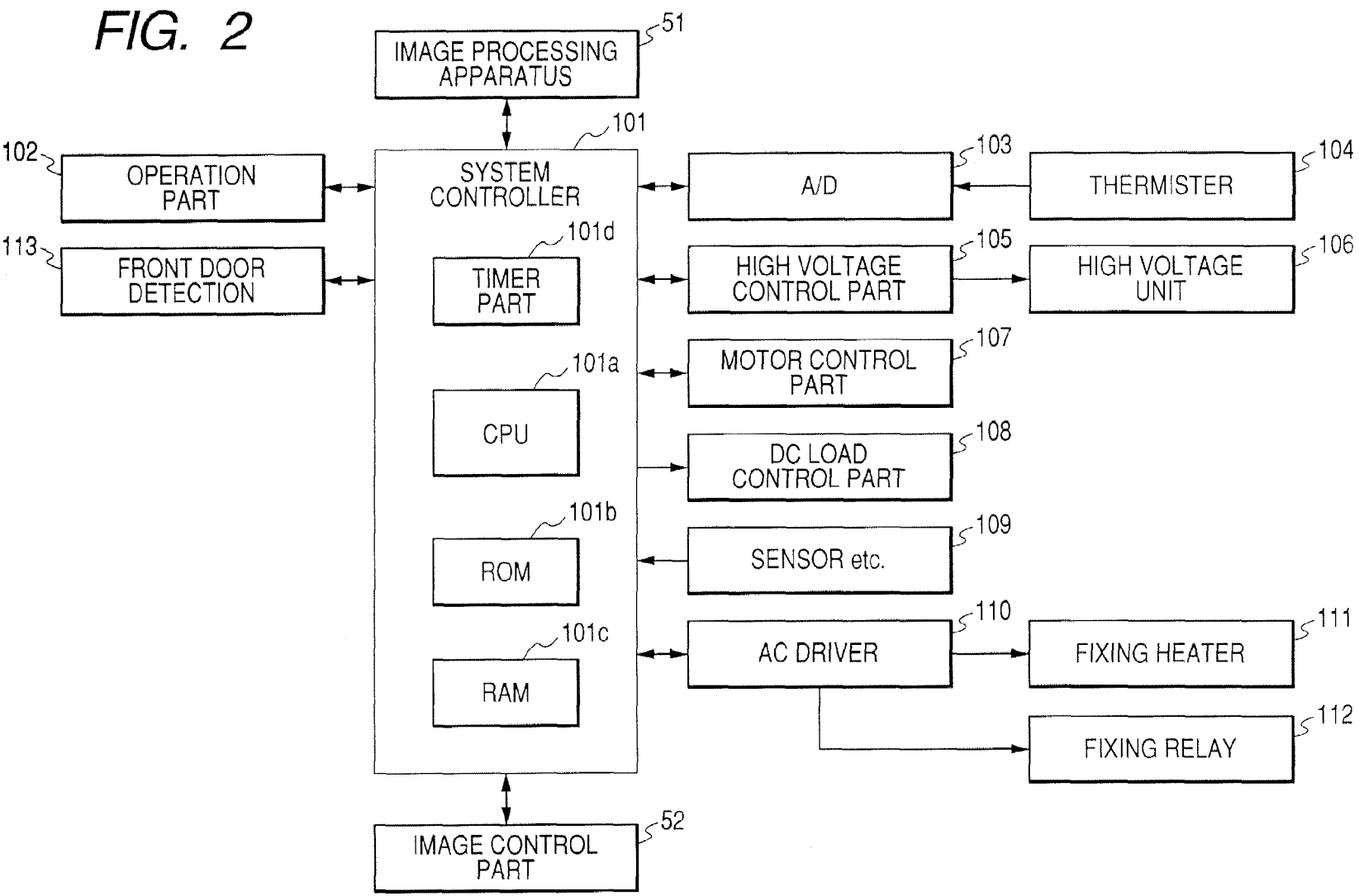
FIG. 2 illustrates a control block diagram for an image forming apparatus relating to the present invention.

Next, FIG. 2 illustrates a control system block diagram for an image forming apparatus.

Overall of the image forming apparatus is integrally controlled by a system controller 101. The system controller 101 mainly controls the drives for each load in the image forming apparatus, the information acquisition and analysis of sensors, and is responsible for exchanging data with the image processing apparatus 51 and the image control part 5 both as described above, and in addition, with an operation part 102, i.e., the user interface. For being responsible as described above, the architecture of the system controller 101 includes a CPU 101*a* which executes various sequences associated with the predefined image forming sequence by the program stored in a ROM 101*b* likewise equipped in the system controller 101. For such execution, a RAM 101*c* is also equipped therein for storing rewritable data necessary to be stored either temporarily or permanently. For instance, the high voltage setting values for a high voltage control part 105 (described below), the various data (described below) and the image forming information to designate image forming from the operation part 102 are stored in the RAM 101*c*.

The primary roles of the system controller 101, i.e., the data exchange with the image processing apparatus 51, the image control part 52 and the operation part 102, are described as follows. With the image processing apparatus 51, various image processing are executed such as analog/digital (A/D) conversion, S/H, shading correction, masking correction, magnification/reduction and LOG conversion for image signal acquired from a not-shown charge-coupled device (CCD). In addition to sending out the specification setting data for each related part required by the image processing as noted above, various signals from the related parts are received such as original image density signals, and an optimum image forming setting is performed by controlling the high voltage control part (described below) 105 and the image control part 5. With the image control part 5, an optimum laser control is performed based upon a specified image size for image forming and a digital video data after the image processing, that is, a necessary setting is performed for a PWM processing of the laser output in this image forming apparatus. With the operation part 102, in addition to acquiring the user specific information such as copy magnification and copy density setting, the data for indicating the condition of the image forming apparatus to the user, such as the number of image forming, the information about whether or not image forming being in operation, paper jam occurrence and its position, are sent out.

The secondary roles of the system controller 101, i.e., driving each load in the image forming apparatus, and the information acquisition and analysis of sensors, are now described. The image forming apparatus is equipped with DC loads such as motors, clutches/solenoids, and sensors such as photo interrupters and micro switches in each respective place therein. That is, by driving motor and other DC loads as adequate, recording sheets are conveyed and each unit is driven, with sensors keeping watch of the operations. Within itself the system controller 101 lets a motor control part 107 control each motor responding to the signals from various sensors 109, and at the same time lets a DC load control part 108 operate clutches/solenoids, thereby making the image forming operation smooth. Also, by sending various high voltage control signals to the high voltage control part 105, the system controller lets a series of charging devices comprising a high voltage unit 106, i.e., the primary charging device 4, the color development unit 7, the black development unit 8 and the transfer charging device 9, apply each applicable high voltage. Further, the fixing roller 21, the pressure roller 23 and the external heating roller 29 constituting the above described fixing apparatus 3, is each mounted with a heater 111 for heating the respective roller. Each heater is on- and off-controlled by AC drivers 110 (Note that here the heater 111 represents the below described heaters 22, 24 and 30 for each respective roller). Also in this application, the fixing roller 21, the pressure roller 23 and the external heating roller 29 are each equipped with a thermistor 104 (Note that here the thermistor 104 represents the below described thermistors 34, 36 and 32 for each respective roller) whose resistance changing with temperature on each roller 21, 23 and 29, each resistance change is converted into voltage by the A/D converter 103 and then inputted to the system controller 101 in the form of digital value. The above described AC drivers 110 are controlled based on these temperature data.

The AC driver 110 also operates a fixing relay 112 turning on and off the power supply to the heaters, each for heating the fixing roller 21, the pressure rollers 23 and the external heating roller 29. The fixing relay 112 is controlled by the on- and off-signals from the system controller 101. In abnormal conditions, the image forming apparatus is protected by the fixing relay 112 cutting off the power to all the heaters. The fixing relay 112 consists of the common switch means herein.

Here, as indicated by FIG. 1, there is a gap between the internal space and the external part in the image forming apparatus. The front door 200 is equipped for jam clearance and maintenance such as device replacement.

There, the system controller 101 is contrived for receiving a signal from a front door detection part 113 for detecting an opening or closing of the front door 200 (refer to FIG. 1) for judging whether the operator (user) opens or closes the front door 200 for jam clearance and the like.

(Construction of Fixing Apparatus)

Figure 3:
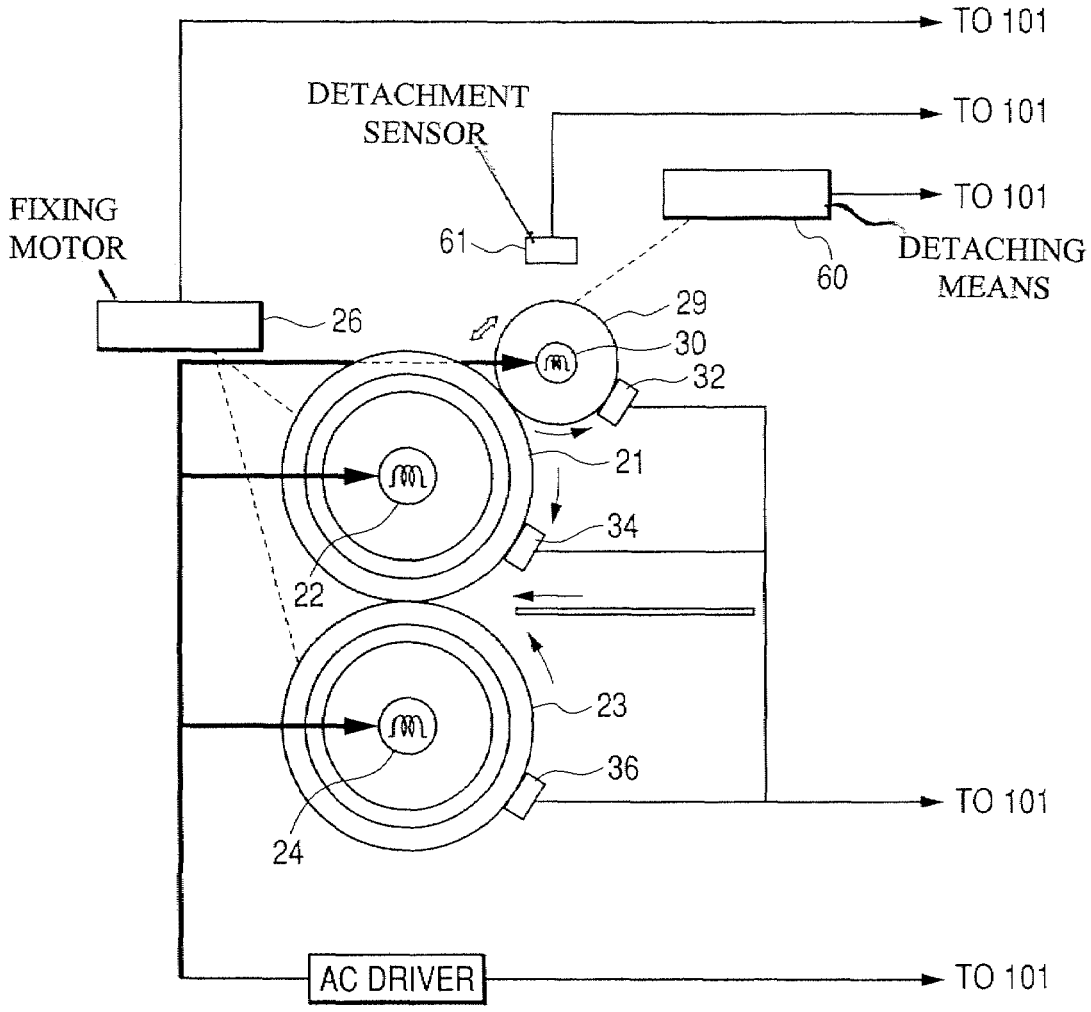
FIG. 3 illustrates a fixing apparatus according to the present invention.

FIG. 3 illustrates a fixing apparatus construction relating to the embodiment of the present invention.

In the fixing apparatus 3 as fixing means, the fixing roller 21 as rotary fixing member with the fixing heater 22 installed therein as heat source, and the pressure roller 23 as rotary pressure member with the pressure heater 24 installed therein as heat source, are disposed to rotate while they are pressed to each other by a not-shown pressure application mechanism.

The construction is such that an unfixed image is fixed when a recording material goes through the fixing nip part formed by the fixing and the pressure rollers.

For a rotary fixing member or rotary pressure member, a roller-type member is used for instance but not limited as such, and instead a belt-type member can be used for heating the recording material.

The fixing roller 21 and the pressure roller 23 are driven by a fixing motor 26 as rotary drive means to rotate. The fixing motor 26 is turned on or off by the system controller 101 corresponding to a color copier operation mode or the surface temperature of the fixing roller.

The fixing roller 21 and the pressure roller 23 are mounted on their surfaces with thermistors 34 and 36, respectively, by which the surface temperatures of the fixing roller 21 and the pressure roller 23, respectively, are detected.

As described above, based on the detected information, the system controller 101 controls the fixing heater 22 and the pressure heater 24 through the AC driver 110, thereby maintaining the fixing and the pressure rollers 21 and 23 at the respectively predetermined temperatures (for this embodiment, 200° C. for the fixing roller 21 and 170° C. for the pressure roller 23).

The AC driver 110 is equipped with switches for turning electric power on or off each of the fixing heater 22, the pressure heater 24 and the below described external heater 30, and each switch is turned on or off by the respective signal output from the system controller 101. Such a switch for each of heaters 22, 24 and 30 can be configured by, but not limited to, semiconductor switch means such as SSR (solid-state relay) or TRIAC.

The above described fixing roller 21 consists of an aluminum core on which circumference a high temperature vulcanization (HTV) silicone rubber layer, and likewise further, a room temperature vulcanization (RTV) silicone rubber layer as thermal resistant elastic layer, and is configured as the thickness being 3 mm and the diameter 40 mm.

Meanwhile the pressure roller 23 consists of an aluminum core on which circumference a high temperature vulcanization (HTV) silicone elastomer of 1 mm thick being layered, and likewise further, a fluorocarbon polymer being layered, and is configured as the diameter being 40 mm. The combination between the above described fixing roller 21 and the pressure roller 23 provides a better release of toner from their surfaces.

And detaching means 60 is disposed for making the external heating roller 29, as external heating member as described above, either in contact with, or detached from, the outer surface of the fixing roller 21.

The external heating roller 29 is contrived to be in contact with, or detached from, the outer surface of the fixing roller 21 through the detaching means 60 by the system controller 101 responding to a detachment sensor 61 as contact-detachment (contact/non-contact) detection means for detecting a contacting or detaching. The detachment sensor 61 is for detecting whether the external heating roller 29 is in contact with, or detached from, the fixing roller 21.

The external heating roller 29, when contacting with the fixing roller 21, is pressed onto the fixing roller 21 by a not-shown spring and driven by the fixing roller.

The external heating roller 29 is also supported by a support shaft such as a thermal insulation bush. And when the support shaft is moved by the detaching means 60, a contacting with or detaching from the fixing roller 21 is accomplished. The contacting or the detaching is performed by using a known technology, such as motor, spring or solenoid.

The above described external heating roller 29 contains of an external heating heater 30 as heating source mounted therein, and a high thermal conductive metal such as aluminum, steel or stainless steel, or coating an rubber or plastics having a high toner release property over the surface of the above described metals. By this the external heating roller 29 has a smaller thermal capacity compared to the fixing roller 21 having an elastic layer configured by rubber, and therefore a warm-up time, i.e., the time to raise the temperature up to the predefined is shorter.

The external heating roller 29 is also mounted on its surface with a thermistor 32 by which the surface temperature of the external heating roller 29 is detected. The system controller 101 controls the external heating heater 30 maintained at a predefined temperature (230° C. for the external heating roller in this embodiment) through the AC driver 110 based on the detected information as described above.

As such, by feeding a recording material through the nip between the fixing roller 21 and the pressure roller 23, an unfixed image formed by development materials including toner and transferred onto the recording material is heat fixed thereon.

For such external heating member, a roller type member having a heat source therein is used for example but not limited as such, and rather, it is possible to configure by using a belt consisting of plastic, elastomer or metal, or by a non-contacting type member heating from a certain distance off the outer surface of a fixing roller, provided that they are capable of heating the outer surface of the fixing roller from outside. It is also possible to configure by applying a high frequency current to a coil mounted opposite to the fixing roller and heating it by magnetic induction.

Figure 4:
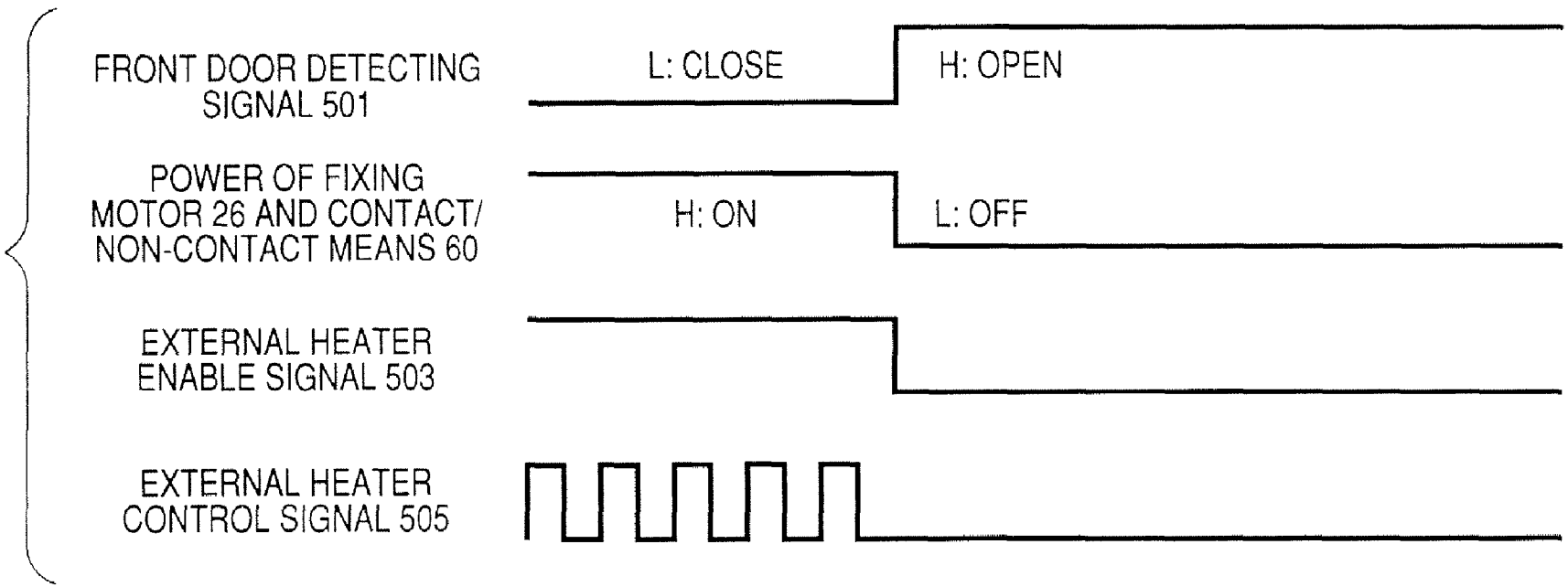
FIG. 4 indicates a processing content of abnormality detection means for a contacting/detaching mechanism relating to the embodiment 1 of the present invention.
Figure 5:
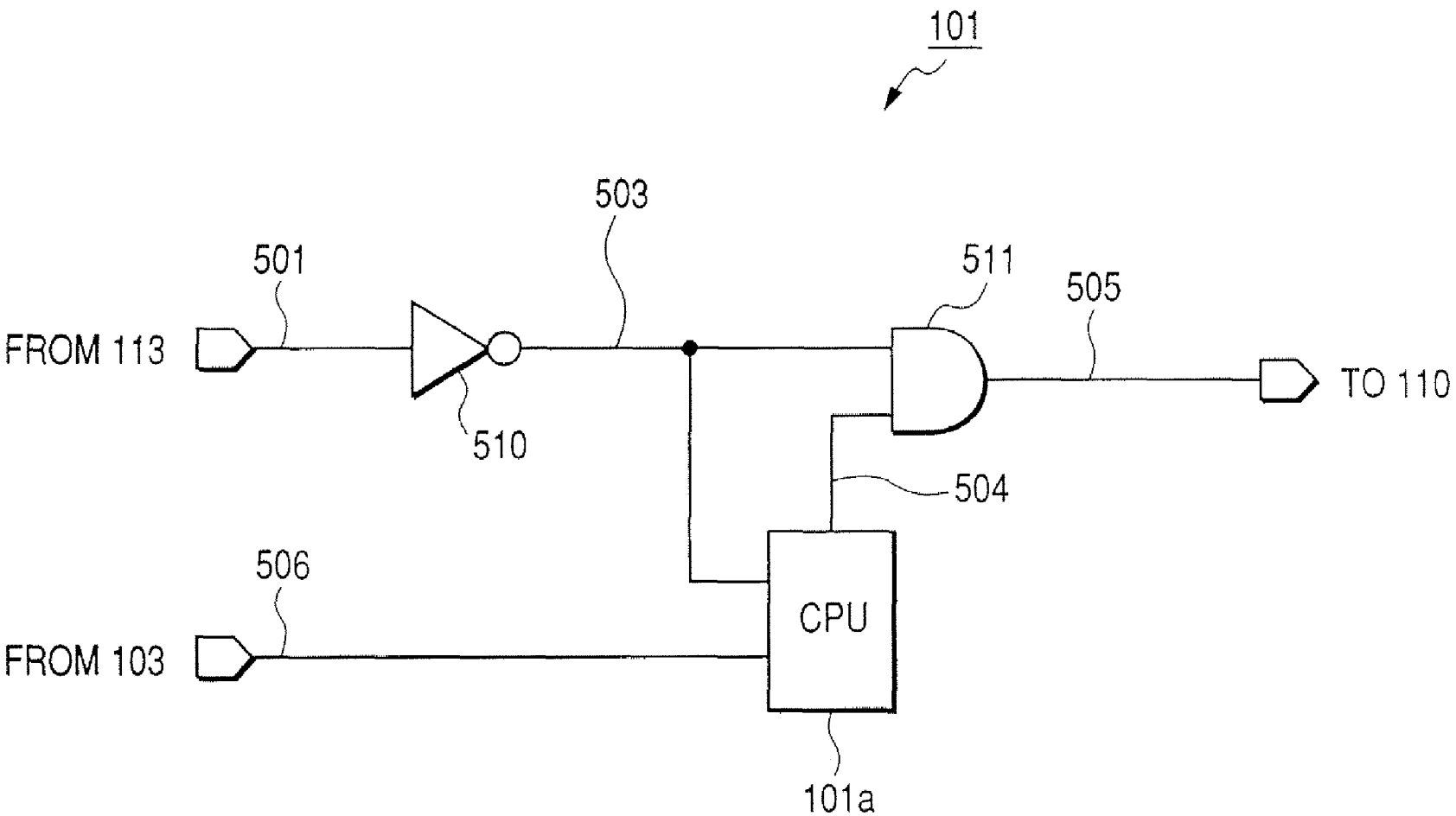
FIG. 5 indicates an embodiment of abnormality detection means for a contacting/detaching mechanism relating to the embodiment 1 of the present invention.
Figure 13:
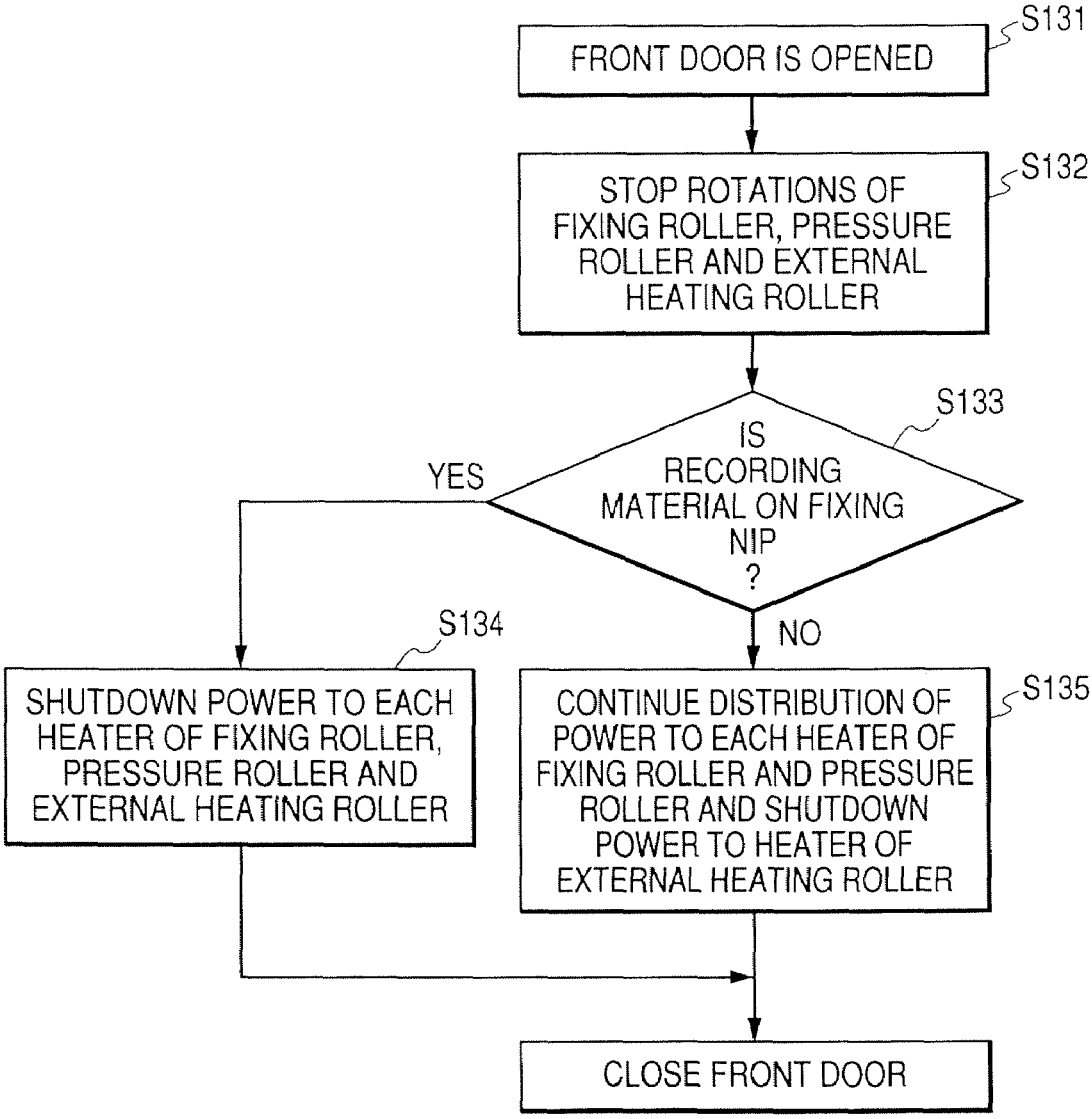
FIG. 13 illustrates a control flow chart for an image forming apparatus relating to the present invention.

Referring to FIGS. 4, 5 and 13, the embodiment of the present invention in more detail is then described below. FIG. 4 is a sequence chart indicating a detection of the front door opening or closing by detection means through a detection signal 501 from the front door detection 113 inputted to the system controller 101, a generation of a heater enabling signal 503 for controlling the external heating heater power-on or -off, and thereby controlling the temperature of the external heating heater.

In this sequence the detection of the front door opening (logic high) by the front door detection signal 501 turns off the power supplied to the fixing motor 26 and the detaching means 60 through an interlock function, and therefore the external heating heater enabling signal 503 is turned off (logic low) and the external heating heater control signal 505 is turned off (logic low), thus turning the external heating heater off.

As such, if the front door is open, the external heating heater is not heated because the power thereto is shut off by these functions, i.e., the power shut-off means. Through this, if the front door is open, a heat supply from the external heating roller is cut off, even though the power supply to the detaching means 60 is shut off and the external heating roller keeps in contact with the fixing roller.

FIG. 5 is a block diagram indicating an external heating heater control circuit relating to the present invention, and an example of the circuit for controlling the external heating heater by the above described external heating heater enabling signal and the logic of the external heating heater control signal 504 for the CPU 101*a* responding to a temperature data 506 from the external heating thermistor 32.

In the external heating heater control circuit, the logic 510 and 511 recognize the situation where the detaching means 60 is unable to detach the external heating roller 29 due to an interlock function when the front door detection signal 501 is logic high, meaning the door opening, then an external heating heater enabling signal 503 is switched to logic low, meaning the heater control being turned off, and the external heating heater control signal 505 is switched to logic low, meaning being turned off.

While the logic 510 and 511 are contrived corresponding to the logic of a color copier relating to this embodiment, if the logic of two signals, i.e., the detection signal 501 from the front door detection 113 and the external heating heater control signal 504 from the CPU 101*a*, are changed by circuit configurations or mechanical constructions, then modifications in the logic 510 and 511 according to each applicable signal logic for the imaging apparatus make a similar heater control possible.

And as in this embodiment, with the external heater heating signal 505 inputted to the AC driver 110 generated by the logic 511 based on the external heating heater enabling signal 503 and the external heating heater control signal 504 from the CPU 101*a*, the external heating heater control signal 505 inputted to the AC driver 110 is kept at logic low, i.e., "off," when the external heating roller is unable to detach itself, thereby protecting the fixing roller by forcibly shutting the power supply to the external heating heater.

Further in this embodiment, since the external heating heater enabling signal 503 and the logic 511 are constructed by a hard wired circuit, enabling the external heating heater control signal 505 being forcibly turned off, thereby securing a protection of the fixing roller, even if a runaway software turns on the external heating heater control signal 504 in the CPU 101*a*.

(Detailed Description of Controlling an Image Forming Apparatus)

Referring to FIGS. 6 through 9, a detailed description of a control relating to the present invention is given below.

(Warm-Up Control)

FIG. 6 illustrates a control detail in the machine warm-up. As shown in FIG. 6, when the main power is first turned on (sequence S1; hereafter called Sn, where n denotes an integer), the external heating roller 29 is moved to the home position (S2) which is defined as the preset position where the external heating roller 29 is detached from the fixing roller 21. The CPU 101*a* featured in the system controller 101 controls the detaching control in which a controlled situation, i.e., either contacting or detaching, an accord or disaccord with the signal on either contacting or detaching, and abnormalities in the detaching means 60 and detachment sensor 61, are verified, and, at the same time the external heating roller 29 is moved to the preset position, i.e., being detached from the fixing roller 21.

Subsequently, a fixing relay is turned on (S3) and whether or not the surface temperature of each roller, i.e., the external heating roller 29, the fixing roller 21 and the pressure roller 23, being at 230° C., 200° C. and 170° C., respectively, is checked (S5) In this sequence, if each surface is at the applicable temperature, the fixing motor 26 is turned off, the external heating roller 29 is detached from the fixing motor 21 and the standby mode is initiated (whereas at immediately after the power on, the control is such that the fixing motor 26 is turned off and the external heating roller 29 is detached from the fixing roller 21).

On the other hand, if each surface is not yet at the applicable temperature (S5), then whether or not the surface of the fixing roller 21 being at the control temperature 200° C. is checked (S6).

If it is not yet at the control temperature, the fixing heater 22 is then turned on (S7), otherwise the fixing heater 22 is turned off (S8).

Subsequently, whether or not the surface of the pressure roller 23 being at the control temperature 170° C. is checked (S9).

If it is not yet at the control temperature, the pressure heater 24 is then turned on (S10), otherwise the pressure heater 24 is turned off (S11).

Then, whether or not the front door opening in the image forming apparatus is checked (S12). If the front door is open at this moment, the external heating heater is turned off (S15) for preventing the fixing roller 21 from damage by the external heating roller 29 heating a certain part thereof because the front door opening disables the drive of the fixing motor 26, while if the front door is closed, a temperature on the external heating roller 29 is checked for control (S13). If the surface of the external heating roller 29 is not yet at the control temperature of 230° C., the external heating heater 30 is turned on (S14), otherwise the external heating heater 30 is turned off (S15).

Subsequent to the above sequence, whether or not each surface of the fixing roller 21 and the external heating roller 29 being at their respective temperatures, at which the external heating roller 29 is moved to the contacting position, is checked (S16) and if each temperature is at the applicable point (in this embodiment, the fixing roller 21 at 120° C. and the external heating roller 29 at 200° C.), then the fixing roller is rotated, followed by making the external heating roller 29 contact with the fixing roller 21 (S19). Note that in the initial warm-up sequence the fixing roller 21 is stationary and the external heating roller 29 is detached from the fixing roller 21.

The above operational sequences are executed until each surface temperature of the external heating roller 29, the fixing roller 21 and the pressure roller 23 reaches at 230° C., 200° C. and 170° C., respectively, at which time the standby sequence is initiated as described later.

As such, if the front door is open, the power supply to the external heating heater is shut off regardless of the surface temperature of the external heating roller 29, thereby preventing from heating a part of the fixing roller 21. Meanwhile the heater each for the fixing roller 21 and the pressure roller 23 is supplied with power so that the surface temperature of each roller is maintained at the respective setup point, regardless of the front door opening or closing.

Referring to FIG. 13 a control flow by the system controller 101 is described in detail when the front door is open as follows.

The system controller 101, when judging the front door opening (S131), first turns off drives on the fixing roller, the pressure roller and the below described external heating roller (S132).

And if the door opening is due to a recording material jam at the fixing apparatus (S133), that is, if there is a recording material is in the fixing nip, the power supply to each heater for the fixing, the pressure and the external heating rollers are immediately shut off (S134).

On the other hand, if the door opening is due to a jam outside of the fixing apparatus (S133), or replacement of a device, that is, there is no recording material at the fixing nip, the power supply to halogen heater for the each of fixing and pressure rollers is continued at the power level regulated by the respective thermistor, while the power to the heater of the external heating roller is shut off (S135).

As such, if a door opening causes a condition in which the fixing roller is stopped with the external heating roller contacting thereon, it is possible to prevent the fixing roller from being locally heated and degraded or damaged, by stopping the external heating roller from heating the outer surface of the fixing roller.

Meanwhile, since the temperature controls for the fixing and the pressure rollers are continued, it is possible to shorten a warm-up time of the fixing apparatus after a door closing preceded by a jam clearance or a device replacement, thereby shortening a restoring time to the condition possible for image forming operation on the image forming apparatus. Accordingly, an image forming operation after the door closing is performed as quickly as possible.

Note that the halogen heater mounted in the fixing roller used in this application is disposed for heating uniformly the overall inside surface of the fixing roller and therefore a problem of the fixing roller damage by a local heating thereof by the external heating roller does not occur.

(Standby Sequence)

Figure 7:
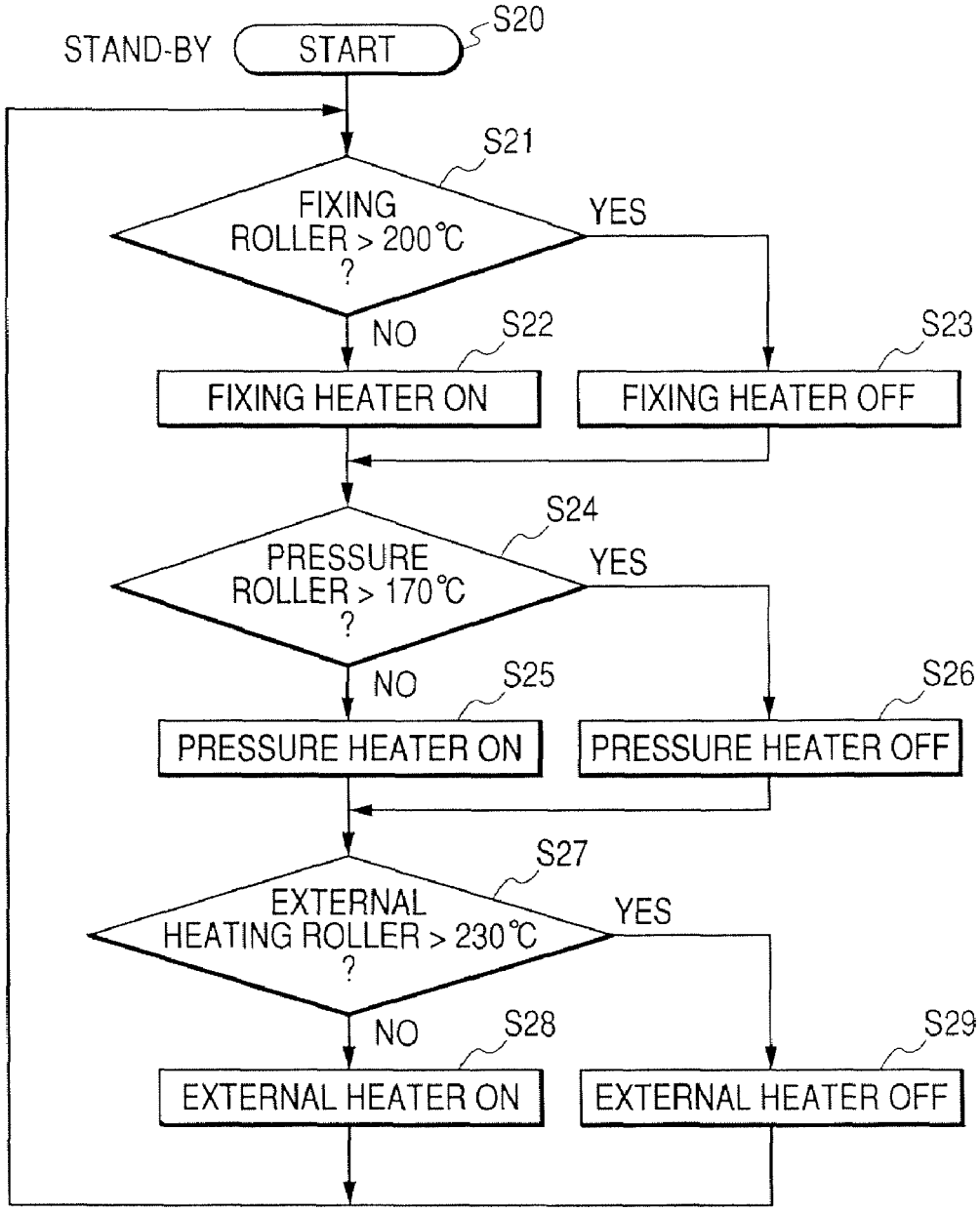
FIG. 7 illustrates a flow chart for a standby sequence for an image forming apparatus relating to the present invention.

Referring to FIG. 7, the standby sequence is described.

Transitioning to the standby (S20), whether or not the surface of the fixing roller 21 being at the control temperature of 200° C. is checked (S21). At this time if the control temperature has not reached, the fixing heater 22 is turned on (S22), otherwise the fixing heater 22 is turned off (S23).

Subsequently, whether or not the surface of the pressure roller 23 being at the control temperature of 170° C. is checked (S24).

At this time if the control temperature has not reached, the pressure heater 24 is turned on (S25), otherwise the pressure heater 24 is turned off (S26).

Further subsequently, whether or not the surface of the external heating roller 29 being at the control temperature of 230° C. is checked (S27), and if it has not reached the control temperature, the external heating heater 30 is turned on (S28), otherwise the external heating heater 30 is turned off (S28).

The above operations are performed during the standby before a color copier performs an image forming operation. And once an image forming operation starts, the below described copy sequence is initiated.

(Copy Sequence)

Figure 8:
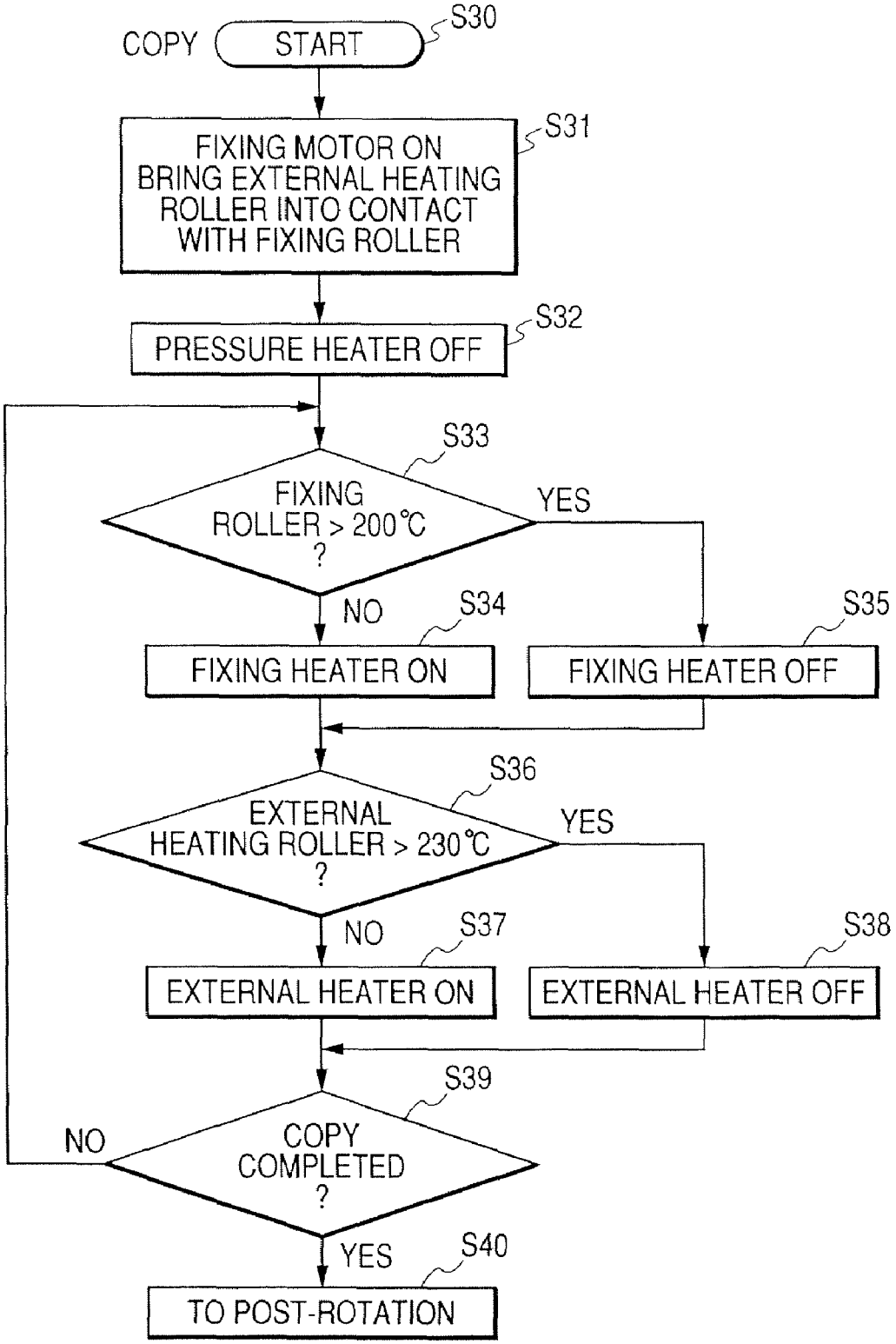
FIG. 8 illustrates a flow chart for a copy sequence for an image forming apparatus relating to the present invention.

Referring to FIG. 8, a copy sequence is then described.

Once a copy sequence is started (S30), the fixing roller is first rotated, followed by making the external heating roller 29 contact with the fixing roller 21 (S31). And the pressure heater 24 is turned off during the copy sequence (S32) for saving electric power, which is enabled by the design of the fixing apparatus 3 having an adequate fixing performance.

Subsequently, whether or not the surface of the fixing roller 21 being at the control temperature 200° C. is checked (S33), and if it has not reached the control temperature, the fixing heater 22 is turned on (S34), otherwise the fixing heater 22 is turned off (S35).

Further subsequently, whether or not the surface of the external heating roller 29 being at the control temperature of 230° C. is checked (S36) and if it has not reached the control temperature, the external heating heater 30 is turned on (S37), otherwise the external heating heater 30 is turned off (S38).

The above sequence is continued until a copy operation (i.e., image forming operation) is finished. If a copy operation is not yet finished, it is reverted back to S33, and if finished, it is moved to a post-rotation sequence (S40).

Figure 9:
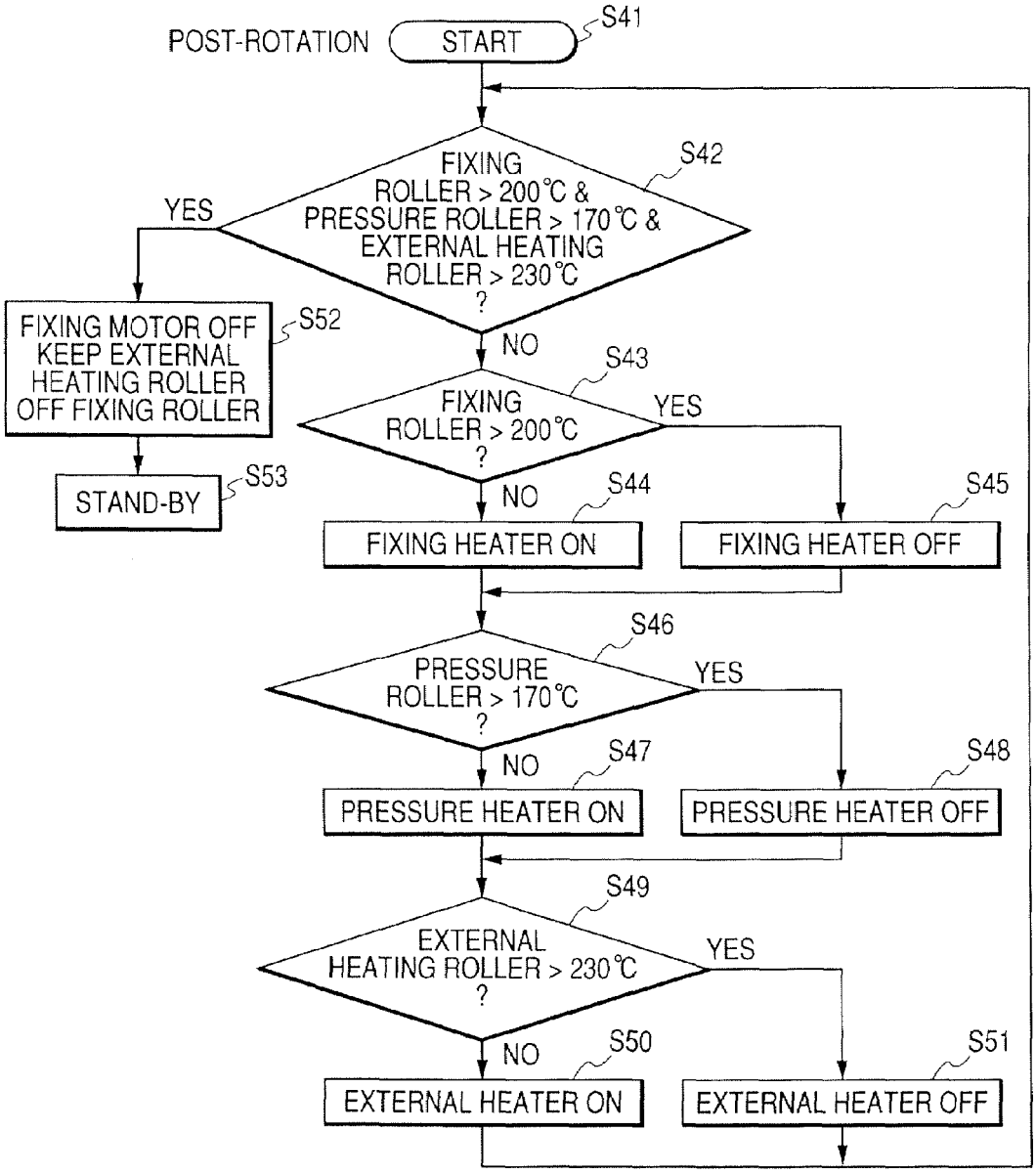
FIG. 9 illustrates a flow chart for a post-rotation sequence for an image forming apparatus relating to the present invention.

Next, the post-rotation sequence is described, referring to FIG. 9. Once the post-rotation sequence is started (S41), whether or not each surface of the external heating roller 29, the fixing roller 21 and the pressure roller 23 being 230° C., 200° C. and 170° C., respectively, is checked (S42).

At this time if each temperature has reached the specified point, the external heating roller 29 is detached from the fixing roller 21 which is then stopped rotating (S52) and the standby is initiated (S53).

On the other hand, if each temperature has not reached the specified point, then whether or not the surface of the fixing roller 21 being at the control temperature of 200° C. is checked (S43).

At this time, if the surface has not reached the control temperature, the fixing heater 22 is turned on (S44), otherwise the fixing heater 22 is turned off (S45).

Subsequently, whether or not the surface of the pressure roller 23 being at the control temperature of 170° C. is checked (S46).

At this time if the surface has not reached the control temperature, the pressure heater 24 is turned on (S47), otherwise the pressure heater 24 is turned off (S48).

Further subsequently, whether or not the surface of the external heating roller 29 being at the control temperature of 230° C. is checked (S49) and if the surface has not reached the control temperature, the external heating heater 30 is turned on (S50), otherwise the external heating heater 30 is turned off (S51).

The above operational sequences are executed until each surface temperature of the external heating roller 29, the fixing roller 21 and the pressure roller 23 reaches at 230° C., 200° C. and 170° C., respectively, at which time the standby sequence is initiated again.

Here, if a paper jam occurs during the copy sequence, the jammed sheet must be removed from the image forming apparatus. In such instance, the front door is kept open. Accordingly in this embodiment, the electric power is shut off the external heating roller so as to cut the power to the external heating roller heater.

Meanwhile, the temperature controls of respective heaters for the fixing roller 21 and the pressure roller 23 are continued for maintaining the each control temperature, except when a recording material is jammed in the fixing apparatus, power is shut off all the rollers for safety reasons.

As described thus far, in the embodiment of the present invention, the contrivance is such that the external heating heater control signal 504 corresponding to the temperature data 506 from the external heating thermistor 32 is outputted from the CPU 101*a* and that the external heating heater control signal 505 outputted to the AC driver 110 is generated by the external heating heater control signal 505 and the logic of the external heating heater enabling signal 503, but the contrivance is not limited as such. An alternative contrivance having the same function is such that the external heating heater control signal 505 is outputted from the CPU 101*a* corresponding to the inputted external heating heater enabling signal and the temperature data 506 from the external heating thermistor 32.

And in this embodiment, while the description is provided by a contrivance using the halogen heater 24 as heat source mounted in the pressure roller 23, it is possible to contrive without using a halogen heater 24.

And, while contact type surface temperature detection means is used for the fixing roller 21, the pressure roller 23 and the external heating roller 29, it is possible to configure with a non-contact type.

Embodiment 2

Figure 10:
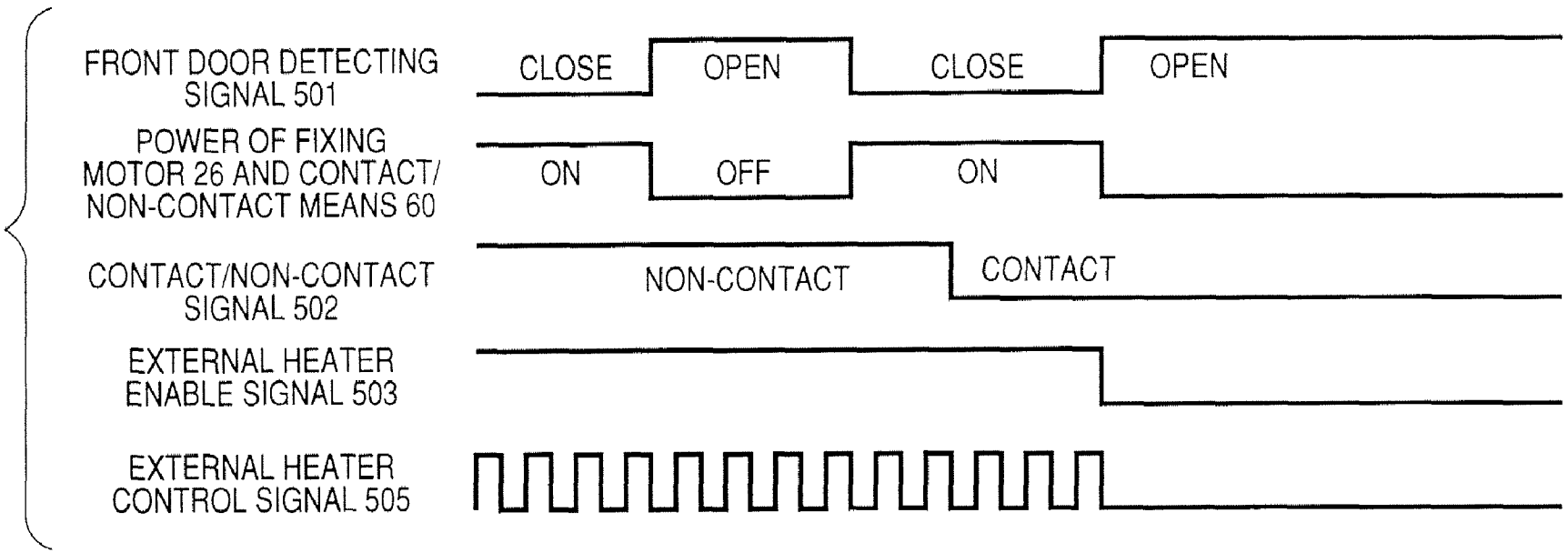
FIG. 10 indicates a processing content of abnormality detection means for a contacting/detaching mechanism relating to the present invention.
Figure 11:
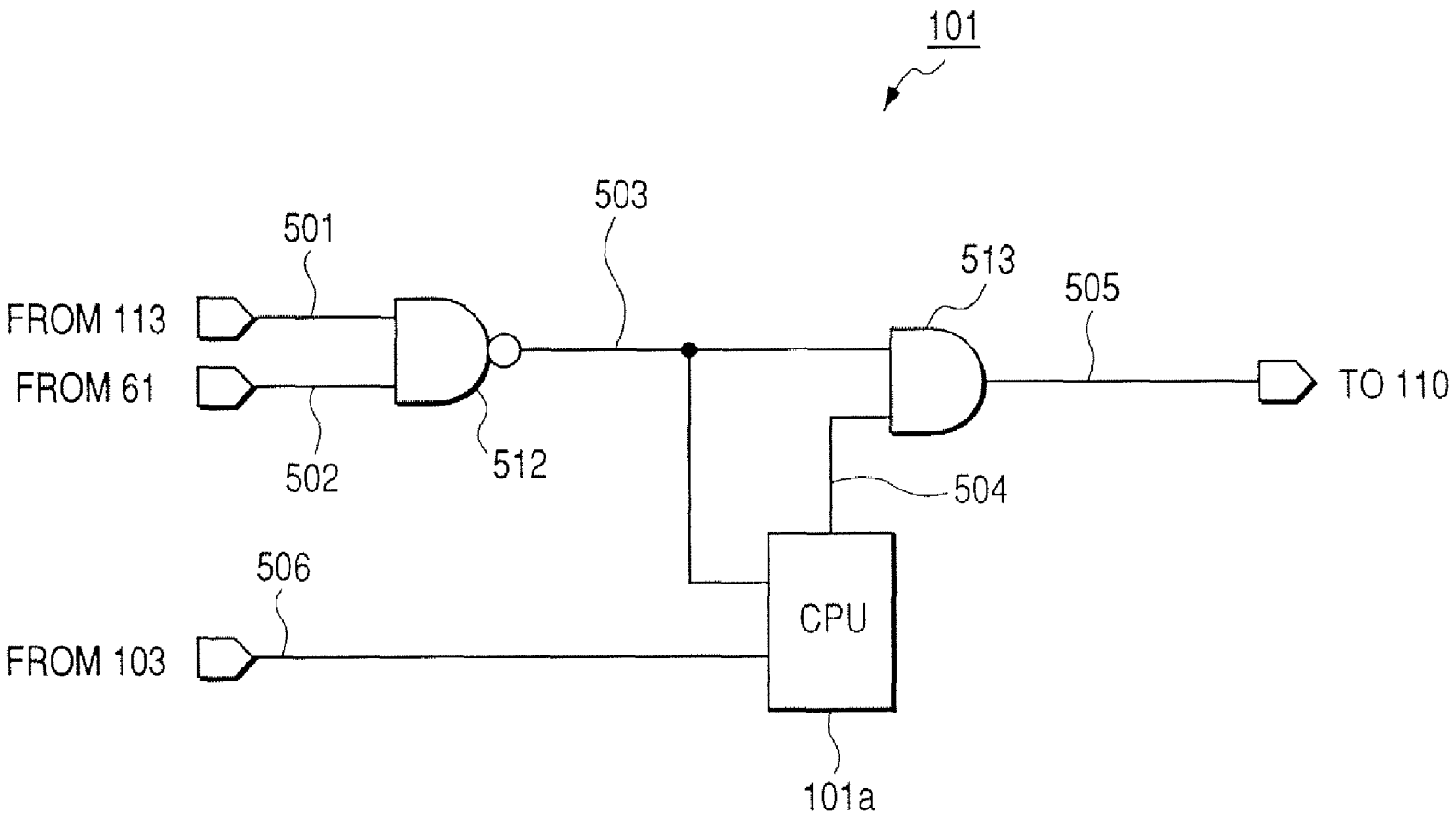
FIG. 11 indicates an embodiment of abnormality detection means for a contacting/detaching mechanism relating to the present invention.

Referring to FIGS. 10, 11 and 12, the preferred embodiment 2 is described in detail as follows. Note that except for FIGS. 4, 5 and 6 of the embodiment 1, they are the same as the embodiment 1 and therefore descriptions are omitted here.

Referring to FIGS. 10 and 11, described below are a sequence and a circuit of this embodiment for turning off the external heating heater control when the front door is open and the external heating roller is in contact with the fixing roller.

FIG. 10 is a sequence chart indicating a detection of a condition of the image forming apparatus by the logic of the two signals inputted to the system controller 101, i.e., a detection signal 501 from the front door detection 113 and a detachment status signal 502 from the detachment sensor 61; a generation of a heater enabling signal 503 for controlling the external heating heater power-on or -off; and thereby controlling the temperature of the external heating heater.

In this sequence the detection of a front door opening (logic high) by the front door detection signal 501 turns off the power (logic low) supplied to the fixing motor 26 and the detaching means 60 through an interlock function. If, in this instance, the detachment sensor signal 502 indicates the contact condition (logic low), then the external heating heater enabling signal 503 is turned off (logic low) and the external heating heater control signal 505 is turned off (logic low), thus turning the external heating heater off.

FIG. 11 is a block chart indicating the external heating heater control circuit relating to the present invention, and an example circuit for controlling the external heater through the above described external heating heater enabling signal and the logic of the CPU 101*a* for the external heating heater control signal 504 responding to a temperature data 506 from the external heating thermistor 32. Note this embodiment contrives that the external heating heater control signal 504 responding to a temperature data 506 from the external heating thermistor 32 is outputted from the CPU 101*a*, and the external heating heater control signal 505 outputted to the AC driver 110 is generated by the external heating heater control signal 504 and the logic of the external heating heater enabling signal 503. However, the same function is provided by an alternative contrivance in which the CPU 101*a*, responding to an inputted external heating heater enabling signal and a temperature data 506 from the external heating heater thermistor 32, outputs the external heating heater control signal 505.

In the external heating heater control circuit, if the front door detection signal 501 is in logic high indicating the door opening and the detachment sensor signal 502 is in logic low indicating the contact by the logic of numerical 512 and 513, then a condition is recognized that the detaching means 60 is unable to detach the external heating roller 29 due to an interlock function, accordingly the external heating heater enabling signal 503 is turned to a logic low, i.e., turning the heater off, and the external heating heater control signal 505 is turned to a logic low, i.e., off.

While the logic of numerical 512 and 513 are contrived corresponding to the logic of a color copier relating to this embodiment, in a case where the logic of three signals, i.e., an open-close detecting signal 501 from the front door detection 113, a contact-detach state signal 502 from the detachment sensor 61 and the external heating heater control signal 504 from the CPU 101*a*, are changed by a circuit configuration or mechanical construction, it is possible to achieve the same heater control by contriving the logic of numerical 512 and 513 corresponding to the respective signal logic for such an image forming apparatus.

And as in this embodiment, if the external heating heater signal 505 inputted to the AC driver 110 is generated by the logic 513 based on the external heating heater enabling signal 503 and the external heating heater control signal 504 from the CPU 101*a*, the external heating heater control signal 505 inputted to the AC driver 110 is kept at logic low, i.e., "off," thereby protecting the fixing roller by forcibly shutting the power supply to the external heating heater when the external heating roller 29 is unable to detach itself.

Further in this embodiment, since the external heating heater enabling signal 503 and the logic 513 are constructed by a hard wired circuit, enabling the external heating heater control signal 505 being forcibly turned off, thereby securing protection of the fixing roller, even if a runaway software turns on the external heating heater control signal 504 in the CPU 101*a*.

Now turning to FIG. 12, a detail of control relating to this embodiment is described below. Note that the control after the warm-up is the same as the embodiment 1 described referring to FIGS. 7, 8 and 9 and therefore the descriptions are omitted herein.

(Warm-Up Control)

FIG. 12 illustrates a control detail in the warm-up. As shown in FIG. 12, when the main power is first turned on (S1), the external heating roller 29 is moved to the home position (S2) which is defined as the preset position where the external heating roller 29 is detached from the fixing roller 21. The CPU 101*a* featured in the system controller 101 controls the detaching control in which a controlled situation, i.e., either contacting or detaching, an accord or disaccord with the signal on either contacting or detaching, and abnormalities in the detaching means 60 and detachment sensor 61, are verified, and at the same time the external heating roller 29 is moved to the preset position, i.e., being detached from the fixing roller 21.

Subsequently, a fixing relay is turned on (S3) and whether or not the surface temperature of each roller, i.e., the external heating roller 29, the fixing roller 21 and the pressure roller 23, being at 230° C., 200° C. and 170° C., respectively, is checked (S5). In this sequence, if each surface is at the applicable temperature, the fixing motor 26 is turned off, the external heating roller 29 is detached from the fixing motor 21 and the standby mode is initiated (whereas at immediately after the power on, the control is such that the fixing motor 26 is turned off and the external heating roller 29 is detached from the fixing roller 21).

On the other hand, if each surface is not yet at the applicable temperature (S5), then whether or not the surface of the fixing roller 21 being at the control temperature of 200° C. is checked (S6)

If it is not yet at the control temperature, the fixing heater 22 is then turned on (S7), otherwise the fixing heater 22 is turned off (S8).

Subsequently, whether or not the surface of the pressure roller 23 being at the control temperature 170° C. is checked (S9).

If it is not yet at the control temperature, the pressure heater 24 is then turned on (S10), otherwise the pressure heater 24 is turned off (S11).

Then, whether or not the front door is open in the image forming apparatus is checked (S12). If the front door is open at this moment, whether or not the external heating roller is contacting with the fixing roller is checked (S4). In this sequence if the external heating roller is contacting the fixing roller, the external heating heater is turned off (S15) to prevent the fixing roller 21 from damage by the external heating roller 29 heating a certain part thereof because the front door opening disables the drive of the fixing motor 26. If the external heating roller is not contacting, or the front door is closed in sequence S12, a temperature check for controlling the external heating roller 29 is performed (S13). That is, if the external heating roller 29 is detected as being detached from the fixing roller 21, the predefined temperature control is performed for the external heating roller. If the surface of the external heating roller 29 has not yet reached at 230° C., the external heating heater 30 is turned on (S14), otherwise the external heating heater 30 is turned off (S15).

Subsequent to the above sequence, whether or not each surface of the fixing roller 21 and the external heating roller 29 being at their respective temperatures, at which time the external heating roller 29 is moved to the contacting position, is checked (S16), and if each temperature is at the predefined point (in this embodiment, the fixing roller 21 at 120° C. and the external heating roller 29 at 200° C.), then the fixing roller is rotated, followed by making the external heating roller 29 contact with the fixing roller 21 (S19). Note that in the initial warm-up sequence the fixing roller 21 is held stationary and the external heating roller 29 is detached from the fixing roller 21.

It is also apparent in this embodiment, even if the front door is open, the power control for the each heater is performed, just as in the door close condition, for maintaining the respective preset temperatures of the fixing roller 21 and the pressure roller 23.

As described thus far, in this embodiment, when a door such as the front door is in transition from a close to an open conditions, power supply to the heater in the external heating roller is decided by a contacting or detaching condition (spacing) of the external heating roller relative to the fixing roller. If in the contacting condition, the power source to the heater is shut off so that the power to the heater in the external heating roller is shut off.

The above operational sequences are executed until each surface temperature of the external heating roller 29, the fixing roller 21 and the pressure roller 23 reaches at 230° C., 200° C. and 170° C., respectively, at which time the standby sequence is initiated as described later.

Embodiment 3

Figure 14:
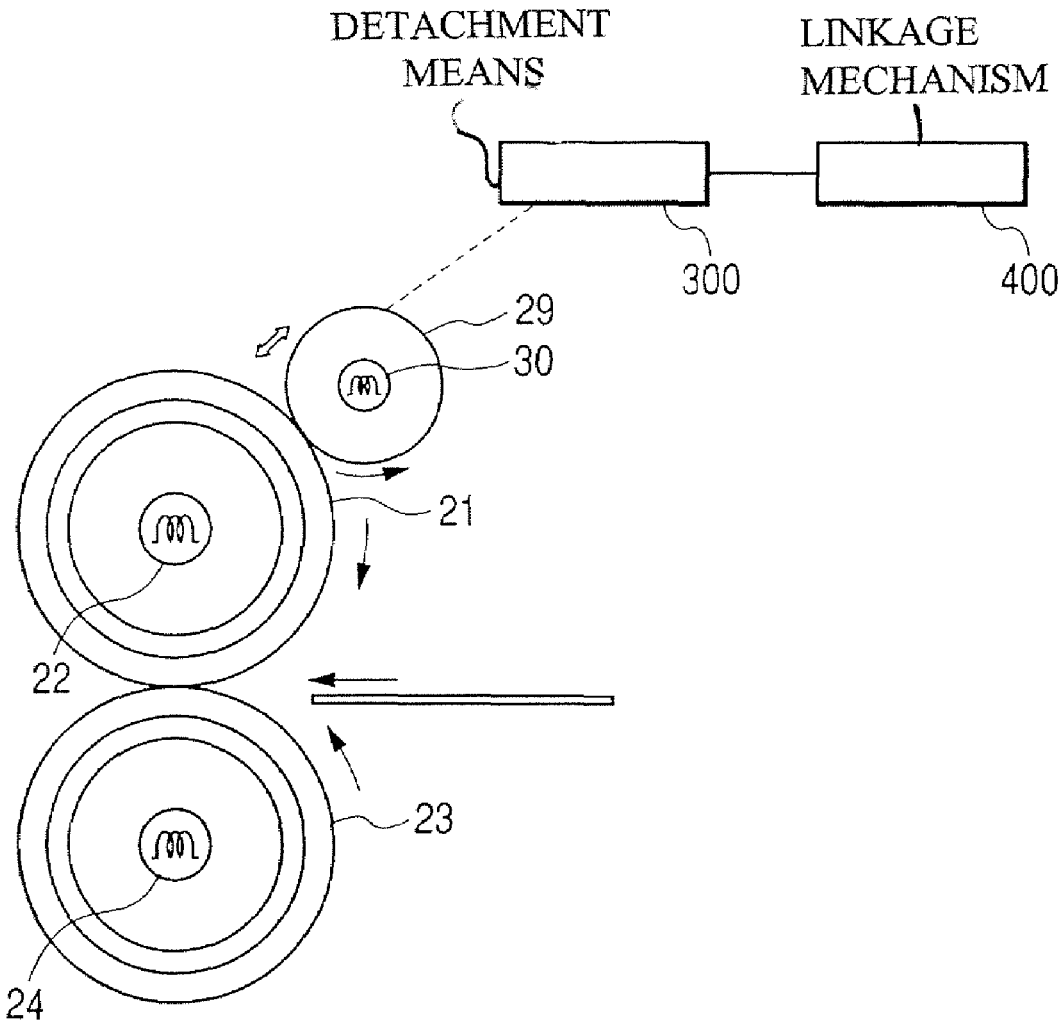
FIG. 14 schematically illustrates a fixing apparatus relating to the present invention.

Now referring to FIG. 14, the embodiment 3 relating to the present invention is described. Note that the members herein having the same functions as in the above embodiments 1 and 2 are assigned the same numbers and detailed descriptions are omitted.

This embodiment, unlike the embodiments 1 and 2, is characterized by detaching the external heating roller in conjunction with the front door opening, excepting which the characteristics of this embodiment is the same as that of the above described embodiments 1 and 2.

As illustrated in FIG. 14, the external heating roller is disposed for detaching itself reliably from the fixing roller by detachment means 300 devised for enabling the external heating roller 29 to contact with, or detach itself from, the fixing roller 21, and by a linkage mechanism 400 for interconnecting between the front door opening and the contacting-detaching operation of the detachment means 300.

Such a configuration, just as the above described embodiments 1 and 2, prevents the external heating roller from heating the fixing roller locally, otherwise causing the latter to be damaged when the front door is open.

Also, if there is no recording material in the fixing nip when the front door is open, the temperature control each for the fixing and the heating rollers is continued as the illustrated flow chart in FIG. 13.

Note that an alternative method using software control is available instead of the above described mechanical devising for detaching the external heating roller in association with the front door opening.

That is, the contrivance is such that the interlock function is delayed for a certain period of time, e.g., two to three seconds, by a delay circuit after the front door opening, instead of cutting the power to certain devices immediately thereafter, during which time the detaching means 300 is commanded by its controller for detaching the external heating roller from the fixing roller.

In sum, while the preferred embodiments 1 through 3 applicable to the present invention are described above, various modifications can be contrived within the idea of the present invention.

This application claims priority from Japanese Patent Application No. 2003-331931 filed Sep. 24, 2003, which is hereby incorporated by reference herein.

What is claimed is:

1. An image forming apparatus, comprising:

first and second fixing members which fix therebetween an unfixed image on a recording material at a fixing nip;

a heating member which heats said first fixing member, said heating member being movable between a first position where said heating member is contacted with an outer surface of said first fixing member and a second position where said heating member is separated from said first fixing member; and a controller which controls supply of electric power to said heating member, wherein said controller stops the supply of electric power to said heating member in association with an opening operation of a door provided with said image forming apparatus when said heating member is in the first position, and said controller permits continuation of the supply of electric power to said heating member in spite of the opening operation of said door when said heating member is in the second position during a standby state.

2. An image forming apparatus according to claim 1, further comprising a heat source which heats said first fixing member from inside of said first fixing member, wherein said controller permits continuation of supply of electric power to said heat source in spite of the opening operation of said door during the standby state.

3. An image forming apparatus according to claim 1, further comprising a heat source which heats said first fixing member from inside of said first fixing member, wherein said controller stops immediately a heating operation of said heating member and a heating operation of said heat source regardless of said door opening or closing when an abnormality in conveying the recording material occurs at the nip.

4. An image forming apparatus according to claim 1, wherein said door is a part of an outer wall in said image forming apparatus.

5. An image forming apparatus according to claim 1, wherein said heating member is a roller having a heat source therein.

6. An image forming apparatus according to claim 1, wherein said first fixing member is contactable with the unfixed image on the recording material.

7. An image forming apparatus according to claim 1, wherein said controller stops rotation of said first fixing member in association with the opening operation of said door.

* * * * *

UNITED STATES PATENT AND TRADEMARK OFFICE

CERTIFICATE OF CORRECTION

PATENT NO. : 7,272,352 B2
APPLICATION NO. : 11/566302
DATED : September 18, 2007
INVENTOR(S) : Hirokazu Kodama It is certified that error appears in the above-identified patent and that said Letters Patent is hereby corrected as shown below:

COLUMN 1:
Line 20, “as” should read --as a--.
Line 22, “roller, feed” should read --roller.--. Feed--.
Line 25, “above described” should read --above-described--.
Line 33, “the” should be deleted.
Line 44, “has” should read --have--.

COLUMN 4:
Line 7, “cetra,” should read --cetera,--.

COLUMN 5:
Line 29, “rollers” should read --roller--.
Line 36, “above” should read --above- --.

COLUMN 6:
Line 63, “above described” should read --above-desribed--.
Line 67, “below described” should read --below-described--.

COLUMN 7:
Line 4, “below described” should read --below-described--.

COLUMN 8:
Line 41, “of” should be deleted.

COLUMN 9:
Line 10, “detection” (second occurrence) should read --detection part--.
Line 50, “detection” should read --detection part--.

COLUMN 10:
Line 29, “checked (S5)” should read --checked (S5).--.
Line 49, “opening” should read --is open--.
Line 65, “checked (S16)” should read --checked (S16),--.

COLUMN 11:
Line 8, “at” should be deleted.
Line 63, “not” should read --not been--.

COLUMN 12:
Line 1, “not” should read --not been--.

UNITED STATES PATENT AND TRADEMARK OFFICE

CERTIFICATE OF CORRECTION

PATENT NO. : 7,272,352 B2
APPLICATION NO. : 11/566302
DATED : September 18, 2007
INVENTOR(S) : Hirokazu Kodama It is certified that error appears in the above-identified patent and that said Letters Patent is hereby corrected as shown below:

COLUMN 13:
Line 1, "at" should be deleted.
Line 53, "detection" (second occurrence) should read --detection part--.

COLUMN 14:
Line 34, "detection" should read --detection part--.

COLUMN 15:
Line 50, "at" should be deleted.
Line 67, "the" (second occurrence) should be deleted.

COLUMN 16:
Line 6, "conditions," should read --condition,--.
Line 14, "at" should be deleted.

Signed and Sealed this

Fifteenth Day of July, 2008

JON W. DUDAS
*Director of the United States Patent and Trademark Office*